US008092240B2

(12) United States Patent
Houir Alami et al.

(10) Patent No.: US 8,092,240 B2
(45) Date of Patent: Jan. 10, 2012

(54) WATERTIGHT ELECTRIC CONNECTION DEVICE INCLUDING TWO CONJUGATED CONNECTION MEMBERS

(75) Inventors: Mounim Houir Alami, Paris (FR); Arnaud Calbel, Vaires sur Marne (FR)

(73) Assignee: Societe d'Exploitation des Procedes Marechal (SEPM), Saint-Maurice Cedex (FR)

( * ) Notice: Subject to any disclaimer, the term of this patent is extended or adjusted under 35 U.S.C. 154(b) by 404 days.

(21) Appl. No.: 12/516,728

(22) PCT Filed: Nov. 28, 2007

(86) PCT No.: PCT/FR2007/001951

§ 371 (c)(1),
(2), (4) Date: May 28, 2009

(87) PCT Pub. No.: WO2008/071882

PCT Pub. Date: Jun. 19, 2008

(65) Prior Publication Data

US 2010/0068929 A1 Mar. 18, 2010

(30) Foreign Application Priority Data

Nov. 29, 2006 (FR) ..... 06 10426

(51) Int. Cl.
*H01R 13/52* (2006.01)

(52) U.S. Cl. ..... 439/278; 439/282

(58) Field of Classification Search ..... 439/271, 439/275, 278–283, 587–589
See application file for complete search history.

(56) References Cited

U.S. PATENT DOCUMENTS

| | | | | |
|---|---|---|---|---|
| 2,458,153 | A * | 1/1949 | Festge | 439/272 |
| 2,501,674 | A | 3/1950 | Graham | |
| 2,567,727 | A * | 9/1951 | Quackenbush | 439/278 |
| 2,755,449 | A | 7/1956 | Anderson | |
| 3,683,315 | A | 8/1972 | Kelly | |
| 4,775,327 | A | 10/1988 | Normann et al. | |
| 6,398,582 | B1 * | 6/2002 | Matsuyama et al. | 439/282 |
| 6,431,888 | B1 | 8/2002 | Crestin | |

FOREIGN PATENT DOCUMENTS

| | | |
|---|---|---|
| EP | 1 102 362 | 7/2002 |
| WO | 02/058193 | 7/2002 |

* cited by examiner

*Primary Examiner* — Felix O Figueroa
(74) *Attorney, Agent, or Firm* — Greenblum & Bernstein, P.L.C.

(57) ABSTRACT

The invention relates to an electric connection device including two conjugated connection devices (1, 2), one of which (2) including an outer casing (12), which are both provided with electric contacts (3; 4*a*, 4*b*) co-operating together in a connection position. The device of the invention is characterised in that the connection member (1) conjugated with the connection member (2) having the outer casing (12) is provided with a flexible tubular outer seal (13) attached at one end to said member (1) and provided with at least one front abutment annular surface (14) that co-operates by contact with a conjugated surface (15) on said casing (12) of the other member (2) and that comprises a rigid or semi-rigid ring (11) provided with means for translation guiding during the coupling of the connection members (1, 2) so that water tightness is provided between said connection members from at least their intermediate rest position to their connection position due to the co-operation between the front abutment annular surface (14) of the seal (13) and the conjugated surface (15) of the casing (12), said seal being further submitted to a creasing in the connection position.

9 Claims, 2 Drawing Sheets

Figure 1:
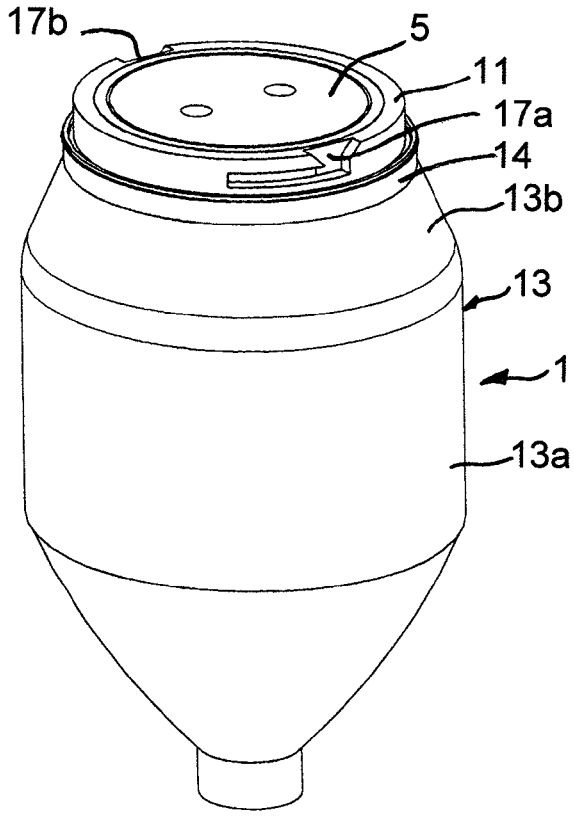

WATERTIGHT ELECTRIC CONNECTION DEVICE INCLUDING TWO CONJUGATED CONNECTION MEMBERS

This invention relates to leak-tight electrical connection device comprising two mating connection elements.

It is known to produce electrical connection devices comprising two mating connection elements, one of which comprises an outer casing, and each of which are provided with electrical contacts intended to cooperate with each other in a connection position, after the coupling of said elements has been obtained by a first relative translational motion, followed by rotation and a second translational motion, the connection elements being in an intermediate rest position at the end of said rotation, wherein said elements are temporarily held together, without the contacts being connected, whereas the connection is established between the contacts of the two connection elements only at the end of the second translational motion, which determines said connection position.

A device such as this is described in particular in the document EP-A1-1 102 362, in the name of the applicant.

For example, one of the elements comprises a socket outlet, or else the movable socket outlet of an extension cord connector, while the other element can be a fixed connector socket or be provided with a grip in order to form a plug.

It is often important, or even mandatory in some locations or environments, to be able to ensure that such a device has a leak-tight seal.

Means have already been conceived of for ensuring a leak-tight seal of the live element, in the absence of a coupling, by providing a cover, for example.

However, it is also necessary to be able to ensure a leak-tight seal of the device both in the intermediate rest position as well as in the connection position.

With a view to ensuring a leak-tight seal such as this, the aforesaid document EP-A1-1 102 362 describes a socket provided with a seal arranged therein, between an insulating block and a casing.

However, a device such as this does not provide satisfaction, and the inventors had to conceive of and find other means.

Furthermore, a connector cable provided with an outer seal is likewise known from the document U.S. Pat. No. 3,683,315.

However, a system such as this is unsuitable for producing a connection device as previously described, in particular because of problems with guiding the connection elements relative to one another, the impossibility of rotating said connection elements one over the other, the impossibility of attaching a safety disc, . . . .

This is why the invention proposes a device of the aforesaid type in connection with the document EP-A1-1 102 362, and which therefore comprises two elements which are coupled together in the manner described hereinabove, but which is remarkable in that the connection element mated with the element comprising the outer casing is provided with a flexible tubular outer seal fastened at one end to said element and provided with at least one annular front stop surface, which is intended to cooperate by contact with a mating surface provided on said casing of the other element, and which comprises a rigid or semi-rigid ring provided with means for ensuring translational guiding during coupling of the connection elements, whereby a leak-tight seal is ensured between said connection elements from at least the intermediate rest position thereof to the connection position thereof, due to the cooperation of the annular front stop surface of the seal and the mating surface of the casing, said seal being further subjected to pleating in the connection position, due to the second relative translational motion of the connection elements, whereas said mating surfaces are designed to enable sliding relative to one another during the rotational motion of said connection elements.

The guide means advantageously comprise a sleeve which is rigidly attached to the seal ring, and which slides on over a fixed portion of the connection element provided with said seal, and, in the case, the sleeve further comprises a means of elastically returning the seal to the initial expanded position thereof.

The casing surface intended to cooperate with the front surface of the seal is preferably tapered and grooved.

According to one embodiment, the seal is accordion-pleated, but according to another particularly advantageous embodiment, the seal is designed to undergo a simple inward folding during the connection moves.

In the latter case, for example, the seal has a circular cylindrical portion at the end thereof which is fastened to the corresponding connection element, and which is extended via a tapered portion which is terminated by the annular front stop surface forming a shoulder.

According to one embodiment, the mating means for guiding in rotation and for holding the connection elements in the intermediate rest position are arranged, on the one hand, on the end ring of the seal and, on the other hand, at the end of the casing, said ring extending beyond the annular front stop surface of the seal and being dimensioned so as to enter at least partially inside said casing.

For example, said mating means for guiding in rotation and for holding in an intermediate position are of the key and keyway type, said keyways having a slope which accentuates the pressure of the annular front stop surface of the seal on the mating surface of the casing.

Figure 2:
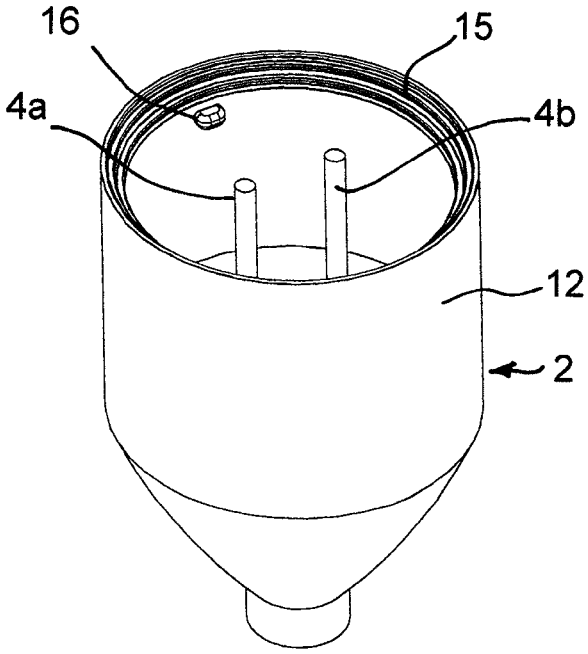
Figure 3:
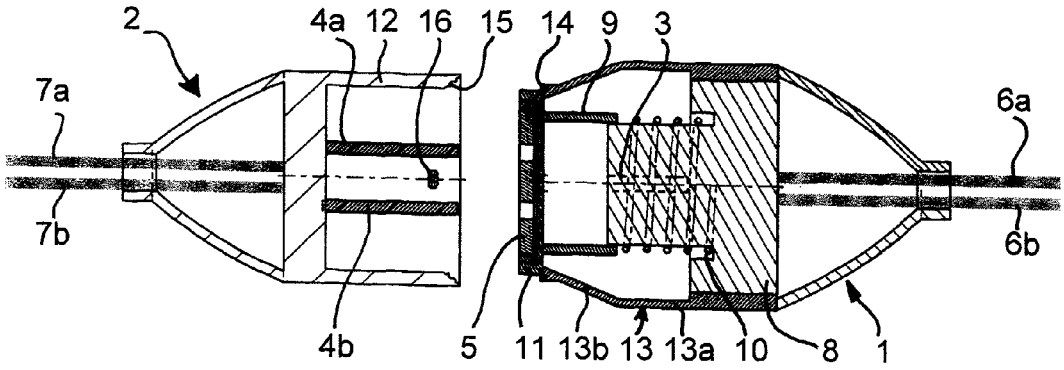
Figure 4:
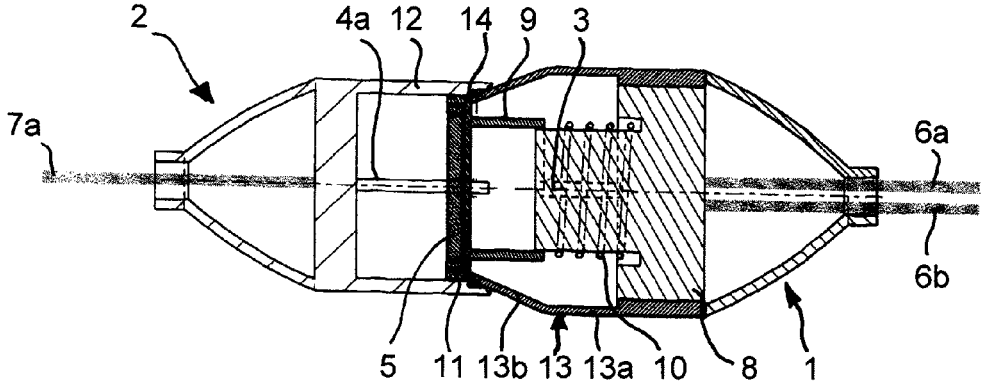
Figure 5:
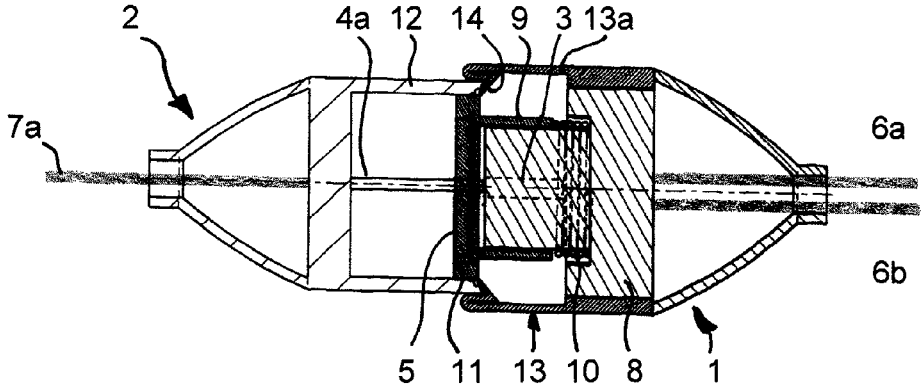

The invention will be well-understood upon reading the following description, which refers to the appended drawings, in which:

FIGS. 1 and 2 show a perspective view of the two component elements of an embodiment of a connection device according to the invention, in the non-limiting form here of an extension cord comprising a movable extension cord outlet (FIG. 1) and a plug (FIG. 2), FIG. 3 shows a longitudinal section of the device of FIGS. 1 and 2, prior to coupling, FIG. 4 is a corresponding section of FIG. 3, but wherein the two elements are shown partially coupled, in the intermediate rest position, FIG. 5 is a corresponding section of FIGS. 3 and 4, but wherein the two elements are shown in the connection position.

Although, for illustrative purposes, the drawings show an extension cord, this could, of course, involve an outlet with a socket, or a connector, as already described hereinabove.

The drawings show a movable extension cord outlet (FIGS. 1 and 3 to 5) intended to cooperate with a plug 2 (FIGS. 2 and 3 to 5), the movable outlet, like the plug, each forming a handle, as shown.

The outlet 1 and the plug 2 are each provided with contacts which, in this case, for example, are in the form of end contacts, such as contact 3 for the outlet, as shown in the drawings, and prongs 4*a*, 4*b* for the plug.

Of course, it is clear that there can be any number of contacts, a central ground contact generally also being provided, but these aspects are separate from this invention.

Contacts 3 could also be sockets rather than end contacts, so as to form so-called prong and socket contacts, the invention likewise being separate from the nature of the contacts.

In the embodiment shown, a so-called rotating safety disc 5 was further provided.

The outlet contacts are current-fed via electrical cables diagrammed at 6*a* and 6*b*.

The contact prongs 4*a*, 4*b* of the plug are likewise connected to electrical cables 7*a*, 7*b*, which are themselves intended to be connected to a machine or device to be supplied with a current.

Contacts 3 of the outlet are mounted in an insulating block 8 which, in the case, is partially surrounded by a sleeve 9 mounted freely in translation and provided with an elastic return means 10 which, in this example, is in the form of a coil spring.

The sleeve 9 terminates in an annular portion forming a ring 11 which, in this example, at least partially surrounds the safety disc 5, at least in the initial position.

As further shown in the drawings, the plug 2 has an outer casing 12 which surrounds the prongs 4*a*, 4*b*, while the movable outlet 1 is provided with a flexible tubular outer seal 13 fastened at one end to a portion of said outlet and at the other end thereof to the ring 11. In this advantageous example, the seal 13 has a circular cylindrical portion 13*a* on the side fastened to the movable outlet 1, which is extended by a tapered portion 13*b*.

In the rest position (FIG. 4), as in the connection position (FIG. 5), the ring 11 of the outlet 1 enters into the casing 12 of the plug 2, while the end of the seal 13 has an annular front surface 14 which, in this case, is in the form of a shoulder, which is intended to coming into sealing contact with a mating surface 15 of said casing, which, in this case, consists of the end section of the latter.

Furthermore, in this example, the surface 15 of the casing 12 is substantially tapered and grooved to ensure a better contact.

The materials used for the casing and the seal and/or the condition of surfaces 14 and 15, are chosen to enable a certain degree of sliding of said surfaces relative to one another, during a rotating motion, as will be specified hereinbelow.

Additionally, as shown more particularly in FIGS. 1 to 3, the outlet 1 and the plug 2 are provided with means of guiding in rotation and of holding the plug 2 inside the outlet 1.

These means are presented in the example shown in the form of keys, in this case, such as key 16 visible in FIGS. 2 and 3, which are arranged on the inside wall of the casing 12, and keyways, such as keyways 17*a*, 17*b*, which are arranged on the ring 11 of the outlet 1, as shown in FIG. 1.

The operation is therefore easy to understand.

Starting with FIG. 1, the outlet 1 and the plug are brought closer together, with a view to the coupling thereof.

The prongs 4*a*, 4*b* are inserted into openings made for this purpose in the safety disk 5, the angular positioning and the first translational motion being guided by the keys 16 and the keyways 17*a*, 17*b* of the elements, while the surfaces 14 and 15 of the seal 13 and the casing 12, respectively, enter into contact, i.e., in abutment against one another.

The keyways 17*a* and 17*b*, which are clearly visible in FIG. 1, then enable the plug 2 and the outlet 1 to be guided in rotation, surfaces 14 and 15 sliding relative to one another until said outlet 1 and said plug 2 assume the position shown in FIG. 4, the so-called rest position.

In this position of FIG. 4, the outlet 1 and the plug 2 are held together by means of the keys 16 and keyways 17*a*, 17*b*.

Furthermore, while still in the position of FIG. 4, the contact between surfaces 14 and 15 is sufficient to ensure a leak-tight seal between the casing 12 of the plug 2 and the seal 13 of the outlet, the latter having already undergone or not undergone a first slight pleating, which will be discussed hereinbelow.

As a matter of fact, the leak-tight seal can result from the simple contact between surfaces 14 and 15, said surfaces being capable of having various shapes in order to improve said leak-tight seal.

The keyways 17*a*, 17*b* can also have a certain slope in order to enable a light clamping.

Next, in order to move from the rest position of FIG. 4 to position of a connection between the prongs 4*a*, 4*b* of the plug 2 with the contacts 3 of the outlet 1, according to FIG. 5, it suffices to carry out a last translational motion guided by the sliding of the sleeve 9 over the insulating block 8, in opposition to the action of the elastic means or spring 10.

This translational motion then results in an inward folding of the seal 13 and therefore longitudinal shortening, as shown in FIG. 5.

It is understood and observed that the tapered portion 13*b* folds over itself inwardly and towards the cylindrical portion 13*a*.

In this connection position of FIG. 5, retaining means (not shown more specifically) are obviously provided.

It is therefore understood that, from at least the intermediate rest position of the elements after the rotation thereof, and as far as the connection position thereof, a leak-tight seal is ensured between the outlet 1 and the plug 2, by means of a seal 13, a seal which resumes the initial position thereof shown in FIG. 1, under the influence of the spring 10, when the connection elements 1, 2 are separated.

Without exceeding the scope of the invention, it is obvious that numerous alternatives can be conceived of, which relate to the associated means, e.g., such as the contacts, the guide means, the absence or existence of the safety disc, or the addition of another disc.

However, it is also clear that the seal 13 can be anticipated according to other embodiments than the one shown. Said seal must be flexible in order to be capable of undergoing pleating, thereby resulting in a longitudinal shortening.

As a matter of fact, according to another embodiment, for example, the seal can be a bellows seal, of the accordion-pleated type, which, during the last translational motion, can undergo a pleating and a compressive shortening of said seal.

In comparison with an accordion-pleated seal, the embodiment shown is less bulky and makes it possible to reduce the diameter of the device while at the same limiting the length, due to the fact that the seal of this embodiment can work (folding and unfolding) within a shorter and narrower cylindrical volume. Furthermore, a shape such as this makes it possible to prevent the accumulation of dirt, which is unavoidable with an accordion shape.

Finally, although accordion pleating enables the obtainment of a more elastic seal because of the pleats of material, the use of a spring makes it possible in every way to use a seal having no elastic strength.

The word "pleating" must therefore be understood in the most general sense thereof, since the seal can be deformed into one or more pleats.

The invention claimed is:

1. Electrical connection device comprising two mating connection elements (1, 2), one (2) of which comprises an outer casing (12), and each of which are provided with electrical contacts (3; 4*a*, 4*b*) intended to cooperate with each other in a connection position, after the coupling of said elements (1, 2) has been obtained by a first relative translational motion, followed by rotation and a second translational motion, the connection elements being in an intermediate rest position at the end of said rotation, wherein said elements are temporarily held together, without the contacts being connected, whereas the connection is established between the contacts of the two connection elements (1, 2) only at the end of the second translational motion, which determines said connection position, characterised in that the connection element (1) mated with the element (2) comprising the outer casing (12) is provided with a flexible tubular outer seal (13) fastened at one end to said element (1) and provided with at least one annular front stop surface (14), which is intended to cooperate by contact with a mating surface (15) provided on said casing (12) of the other element (2), and which comprises a rigid or semi-rigid ring (11) provided with means for ensuring translational guiding during coupling of the connection elements (1, 2), whereby a leak-tight seal is ensured between said connection elements from at least the intermediate rest position thereof to the connection position thereof, due to the cooperation of the annular front stop surface (14) of the seal (13) and the mating surface (15) of the casing (12), said seal (13) being further subjected to pleating in the connection position, due to the second relative translational motion of the connection elements, whereas said mating surfaces (14, 15) are designed to enable sliding relative to one another during the rotational motion of said connection elements (1, 2).

2. Electrical connection device of claim 1, characterised in that the guide means a sleeve (9) which is rigidly attached to the seal (13) ring (11), and which slides on over a fixed portion (8) of the connection element (1) provided with said seal (13).

3. Electrical connection device of claim 2, characterised in that the sleeve (9) further comprises a means (10) of elastically returning the seal (13) to the initial expanded position thereof.

4. Electrical connection device of claim 1, characterised in that the surface (15) of the casing (12) intended to cooperate with the front surface (14) of the seal (13) is tapered and grooved.

5. Electrical connection device of claimed 1, characterised in that the seal (13) is accordion-pleated.

6. Electrical connection device of claim 1, characterised in that the seal (13) is designed to undergo a simple inward folding during the connection moves.

7. Electrical connection device of claim 6, characterised in that the seal (13) has a circular cylindrical portion (13*a*) at the end thereof which is fastened to the corresponding connection element (1), and which is extended via a tapered portion (13*b*) which is terminated by the annular front stop surface (14) forming a shoulder.

8. Electrical connection device of claim 1, characterised in that mating means (16 ; 17*a*,17*b*) for guiding in rotation and for holding the connection elements in the intermediate rest position are arranged, on the one hand, on the end ring (11) of the seal (13) and, on the other hand, at the end of the casing, said ring extending beyond the annular front stop surface (14) of the seal and being dimensioned so as to enter at least partially inside said casing (12).

9. Electrical connection device of claim 8, characterised in that said mating means for guiding in rotation and for holding in an intermediate position are of the key (16) and keyway (17*a*, 17*b*) type, said keyways having a slope which accentuates the pressure of the annular front stop surface (14) of the seal (13) on the mating surface (15) of the casing (12).

* * * * *